US009808129B2

(12) United States Patent
Yazzie

(10) Patent No.: US 9,808,129 B2
(45) Date of Patent: Nov. 7, 2017

(54) SPLASH GUARD APPARATUS

(71) Applicant: Samuel Yazzie, Cont. Divide, NM (US)

(72) Inventor: Samuel Yazzie, Cont. Divide, NM (US)

( * ) Notice: Subject to any disclaimer, the term of this patent is extended or adjusted under 35 U.S.C. 154(b) by 231 days.

(21) Appl. No.: 14/656,852

(22) Filed: Mar. 13, 2015

(65) Prior Publication Data

US 2016/0262575 A1 Sep. 15, 2016

(51) Int. Cl.
*A47K 3/30* (2006.01)

(52) U.S. Cl.
CPC ..... *A47K 3/302* (2013.01); *A47K 2003/305* (2013.01)

(58) Field of Classification Search
CPC ..... A47K 3/302
USPC ..... 4/609
See application file for complete search history.

(56) References Cited

U.S. PATENT DOCUMENTS

| | | | |
|---|---|---|---|
| 3,952,337 | A | 4/1976 | Hansow |
| 4,765,001 | A | 8/1988 | Smith |
| D306,900 | S | 3/1990 | Walton |
| 5,274,859 | A | 1/1994 | Redman et al. |
| 5,365,619 | A | 11/1994 | Solomon |
| 5,606,752 | A | 3/1997 | Shenton, Jr. et al. |
| 5,991,941 | A | 11/1999 | Rivet |
| 6,341,388 | B1 | 1/2002 | Roberts |
| 2009/0199333 | A1 | 8/2009 | Schmitz |
| 2011/0179567 | A1 | 7/2011 | Tang |

*Primary Examiner* — Tuan N Nguyen

(57) ABSTRACT

A splash guard apparatus includes an elongated wall having a first end, a second end, a first lateral surface, a second lateral surface, an upper edge and a lower edge. The elongated wall is comprised of a water impermeable material, the elongated wall is flexible. A plurality of couplers is attached to the elongated wall along the lower edge. Each of the couplers releasably engages a wall adjacent to a bathing area.

7 Claims, 4 Drawing Sheets

SPLASH GUARD APPARATUS

BACKGROUND OF THE DISCLOSURE

Field of the Disclosure

The disclosure relates to bathing splash guard devices and more particularly pertains to a new bathing splash guard device for inhibiting movement of water outside of a bathing area.

SUMMARY OF THE DISCLOSURE

An embodiment of the disclosure meets the needs presented above by generally comprising an elongated wall having a first end, a second end, a first lateral surface, a second lateral surface, an upper edge and a lower edge. The elongated wall is comprised of a water impermeable material, the elongated wall is flexible. A plurality of couplers is attached to the elongated wall along the lower edge. Each of the couplers is configured to releasably engage a wall adjacent to a bathing area.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
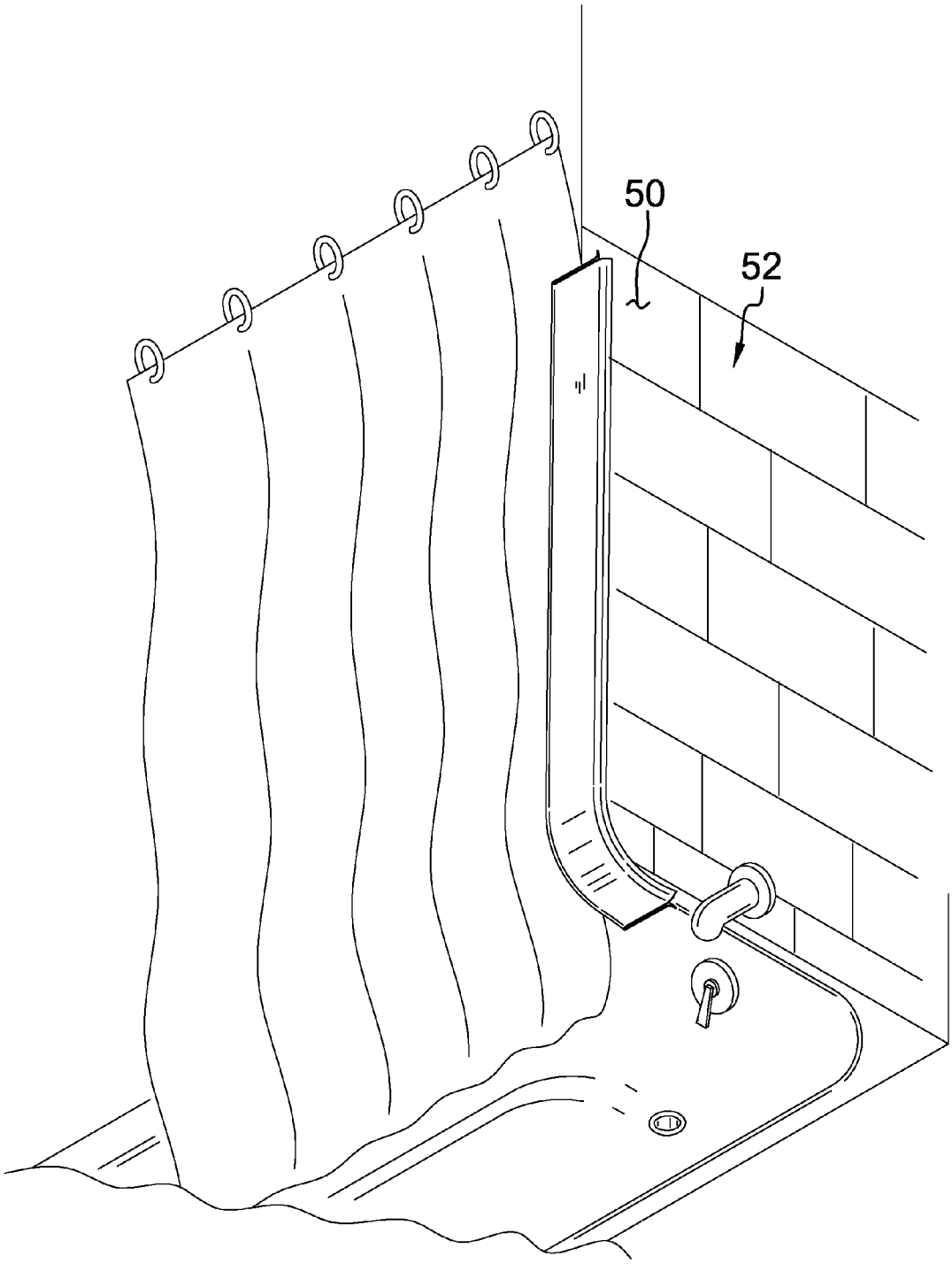
FIG. 1 is a perspective in-use view of a splash guard apparatus according to an embodiment of the disclosure.
Figure 2:
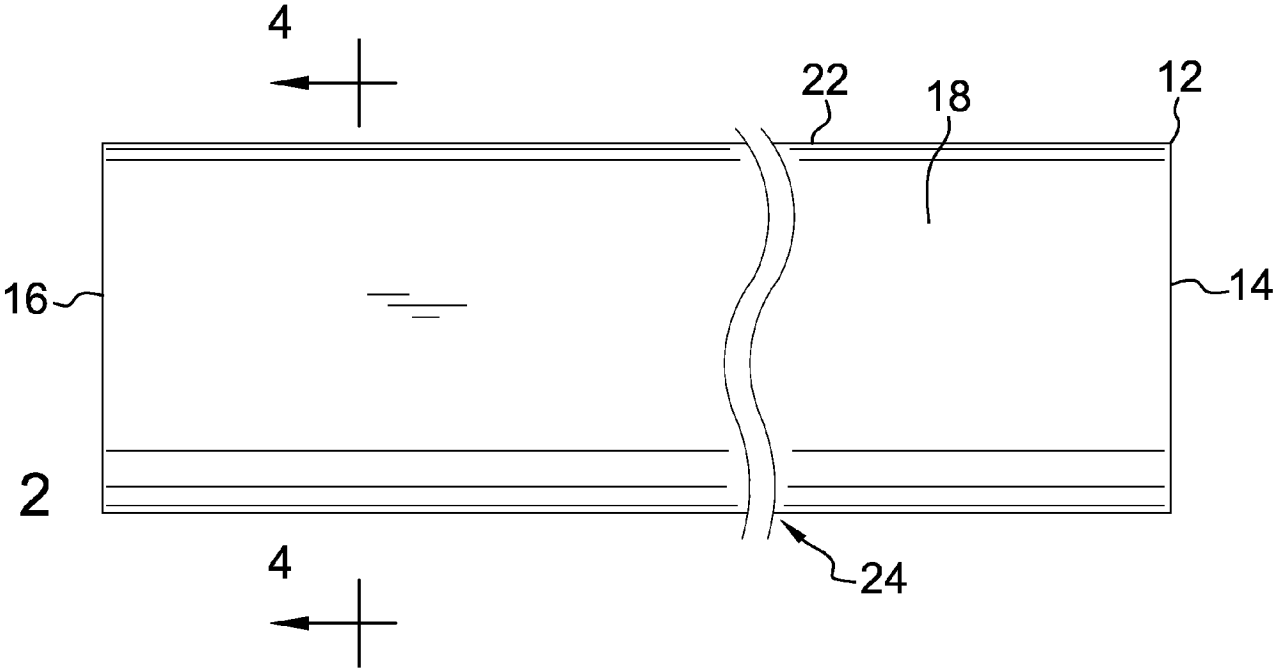
FIG. 2 is a front view of an embodiment of the disclosure.
Figure 3:
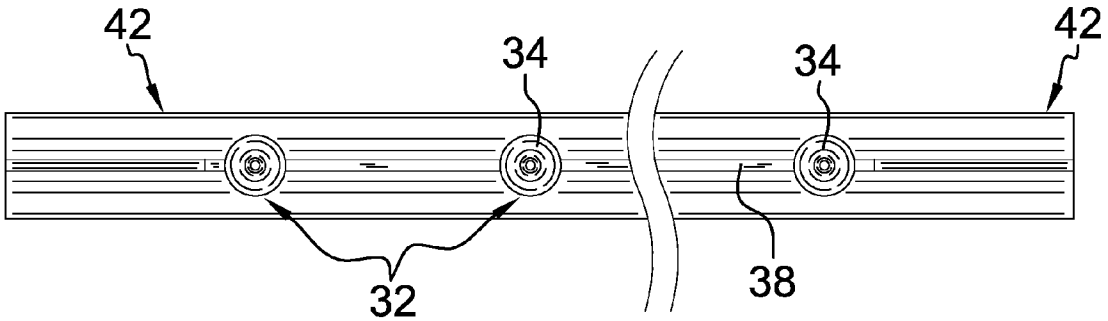
FIG. 3 is a bottom view of an embodiment of the disclosure.

With reference now to the drawings, and in particular to FIGS. 1 through 5 thereof, a new bathing splash guard device embodying the principles and concepts of an embodiment of the disclosure and generally designated by the reference numeral 10 will be described.

As best illustrated in FIGS. 1 through 5, the splash guard apparatus 10 generally comprises an elongated wall 12 having a first end 14, a second end 16, a first lateral surface 18, a second lateral surface 20, an upper edge 22 and a lower edge 24. The elongated wall 12 is comprised of a water impermeable material and is flexible. The material may comprise a plastic or elastomeric material. The lower edge 24 includes a first flap 26 associated with the first lateral surface 18 and a second flap 28 associated with the second lateral surface 20. Each of the first 26 and second 28 flaps extends from the first end to the second end. The first 26 and second 28 flaps each have a free edge 30 and the free edges 30 of the first 26 and second flaps 28 taper away from each other. The first 18 and second 20 lateral surfaces are concavely arcuate adjacent to associated ones of the first 26 and second 28 flaps.

A plurality of couplers 32 is attached to the elongated wall 12 along the lower edge 24. Each of the couplers 32 is positioned between the first 26 and second 28 flaps. The couplers 32 are configured to releasably engage a wall 50 adjacent to a bathing area 52 and each of the couplers 32 may comprise a suction cup 34. A line extending through the free edges 30 is coplanar with or positioned below a plane of a terminal end 35 of the couplers 32. Thus, when the couplers 32 engage a wall 50, the free edges 30 will abut the wall 50 and form a seal between the elongated wall 12 and the wall 50 of the bathing area 52.

Figure 4:
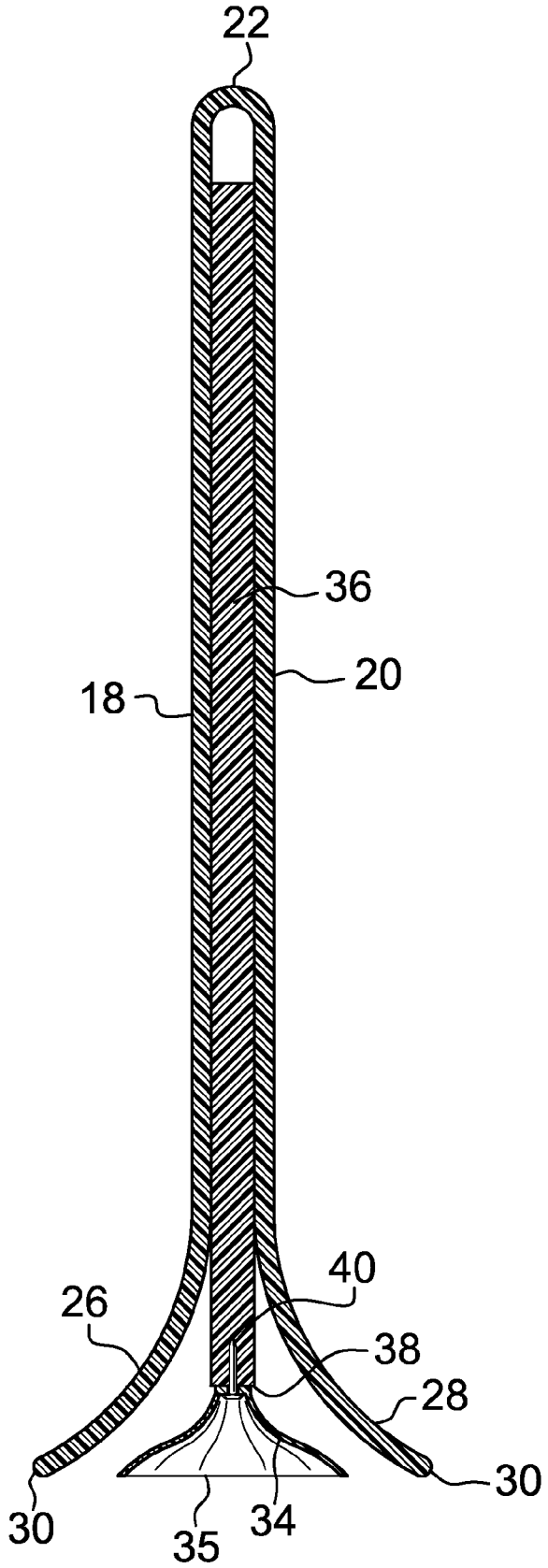
FIG. 4 is a cross-sectional view of an embodiment of the disclosure taken along line 4-4 of FIG. 2.
Figure 5:
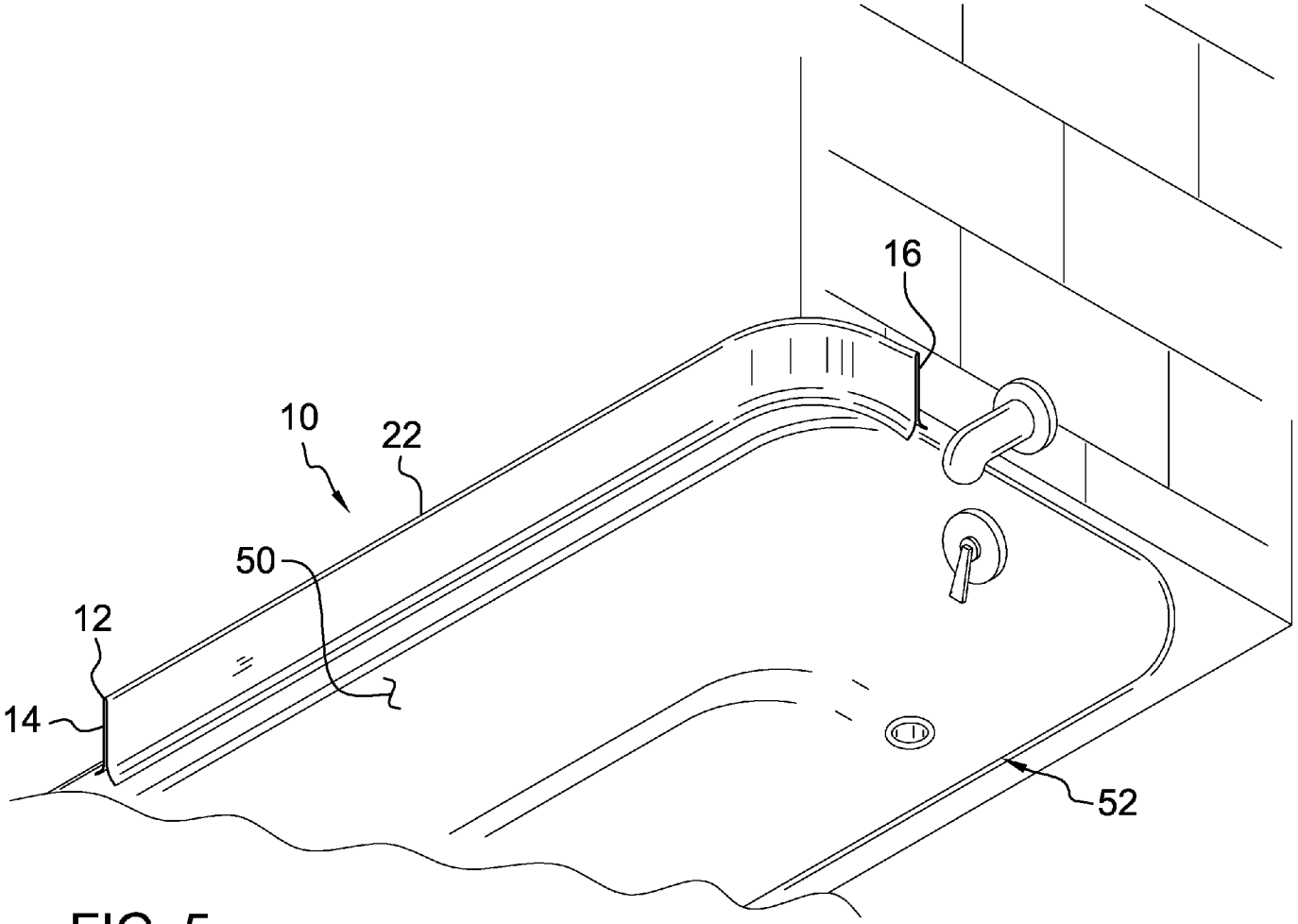
FIG. 5 is a perspective in-use view of an embodiment of the disclosure.

As can be seen in FIG. 4, an interior wall 36 may be positioned between the first 14 and second 16 lateral walls. The interior wall 36 provides additional rigidity to the apparatus 10 to retain it in an upright orientation. Further, the interior wall 36 has a bottom edge 38 to which the couplers 34 may be secured with a fastener 40. Thus, the interior wall 36 may be covered with the elongated wall 12. The interior wall 36 may have a smaller length than the elongated wall 12 such that the interior wall 36 is spaced from the first 14 and second 16 ends a distance of at least 6.0 inches. This will provide for bendable end portions 42 of the elongated wall 12 to allow for easier curving of the elongated wall as can be seen in FIGS. 1 and 5.

In use, the apparatus 40 is attached to a wall 50 adjacent to a bathing area 52 and the wall 40 in may include one adjacent to a shower or an upper edge of a bathtub. The apparatus 10 inhibits water from leaving a bathing area 52 such as between a shower stall wall and a shower curtain.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A movable splash guard assembly configured to retain water within a bathing area, said splash guard assembly comprising:

an elongated wall having a first end, a second end, a first lateral surface, a second lateral surface, an upper edge and a lower edge, said elongated wall being comprised of a water impermeable material, said elongated wall being flexible;

a plurality of couplers being attached to said elongated wall along said lower edge, each of said coupler being configured to releasably engage a wall adjacent to a bathing area;

wherein said lower edge includes a first flap associated with said first lateral surface and extending from said first end to said second end, said first flap having a free edge tapering outwardly from said elongated wall, said first lateral surface being concavely arcuate adjacent to said first flap; and said lower edge having a second flap associated with said second lateral surface, said second flap extending from said first end to said second end, said second flap having a free edge, said free edges of said first and second flaps tapering away from each other, each of said first and second lateral surfaces being concavely arcuate adjacent to associated ones of said first and second flaps.

2. The movable splash guard assembly according to claim 1, wherein each of said couplers are positioned between said first and second flaps.

3. The movable splash guard assembly according to claim 2, wherein each of said couplers comprising a suction cup.

4. The movable splash guard assembly according to claim 1, wherein each of said couplers comprising a suction cup.

5. The movable splash guard assembly according to claim 1, further including an interior wall being positioned between said first and second lateral walls, said interior wall extending substantially between said first and second ends, said interior wall having a bottom edge, said couplers being secured to said interior wall.

6. The movable splash guard assembly according to claim 2, further including an interior wall being positioned between said first and second lateral walls, said interior wall having a bottom edge, said couplers being secured to said interior wall.

7. A movable splash guard assembly configured to retain water within a bathing area, said splash guard assembly comprising:

an elongated wall having a first end, a second end, a first lateral surface, a second lateral surface, an upper edge and a lower edge, said elongated wall being comprised of a water impermeable material, said elongated wall being flexible, said lower edge including a first flap associated with said first lateral surface and a second flap associated with said second lateral surface, each of said first and second flaps extending from said first end to said second end, each of said first and second flaps having a free edge, said free edges of said first and second flaps tapering away from each other, each of said first and second lateral surfaces being concavely arcuate adjacent to associated ones of said first and second flaps;

a plurality of couplers being attached to said elongated wall along said lower edge, each of said couplers being positioned between said first and second flaps, each of said coupler being configured to releasably engage a wall adjacent to a bathing area, each of said couplers comprising a suction cup; and an interior wall being positioned between said first and second lateral walls, said interior wall having a bottom edge, said couplers being secured to said interior wall.

* * * * *